United States Patent [19]

Ohgami et al.

[11] 4,363,305

[45] Dec. 14, 1982

[54] CONTROL SYSTEM

[75] Inventors: Masaaki Ohgami, Musashino; Hitoshi Suzuki, Chofu, both of Japan

[73] Assignee: Fuji Jukogyo Kabushiki Kaisha, Tokyo, Japan

[21] Appl. No.: 174,387

[22] Filed: Aug. 1, 1980

[30] Foreign Application Priority Data

Aug. 2, 1979 [JP] Japan ..... 54-98854

[51] Int. Cl.[3] ..... F02B 3/08; F02B 32/00

[52] U.S. Cl. ..... 123/440; 123/438; 123/489

[58] Field of Search ..... 123/440, 438, 434, 443, 123/489; 60/276, 285

[56] References Cited

U.S. PATENT DOCUMENTS

| | | | |
|---|---|---|---|
| 4,131,089 | 12/1978 | Fujishiro et al. | 123/440 |
| 4,132,200 | 1/1979 | Asano et al. | 123/440 |
| 4,174,689 | 11/1979 | Hosaka | 123/440 |

*Primary Examiner*—Raymond A. Nelli

*Attorney, Agent, or Firm*—Martin A. Farber

[57] ABSTRACT

An air-fuel ratio control system for an internal combustion engine comprises an intake passage, an air-fuel mixture supply means, electromagnetic means for correcting the air-fuel ratio of the air-fuel mixture supplied by the air-fuel mixture supply means, an exhaust passage, and a feedback control system. The error signal in the feedback control system is oscillated by a dither signal having a periodical pattern for oscillating the air-fuel ratio of the mixture. The dither signal comprises a plurality of positive excursions and negative excursions, and at least one of the positive excursions is lower than the other and at least one of the negative excursions is lower than the other. The dither signal is applied to the electromagnetic means for oscillating the air-fuel ratio of the mixture.

A detector senses the concentration of exhaust gases.

The detector produces an output signal in which the portion corresponding to the low positive excursion or low negative excursion of the dither signal is removed, when the air-fuel ratio of the mixture deviates from the stoichiometric ratio.

A comparing circuit compares the shape of the waveform of the output signal of the detector with the dither signal for generating an output corresponding to the removed portion. The output signal is fed to a shift signal generating crcuit for shifting the dither signal for correcting the deviation of value of the controlled output. The period of the dither signal is reduced as the engine speed increases for accurate detection of the air-fuel ratio of the exhaust gases.

5 Claims, 14 Drawing Figures

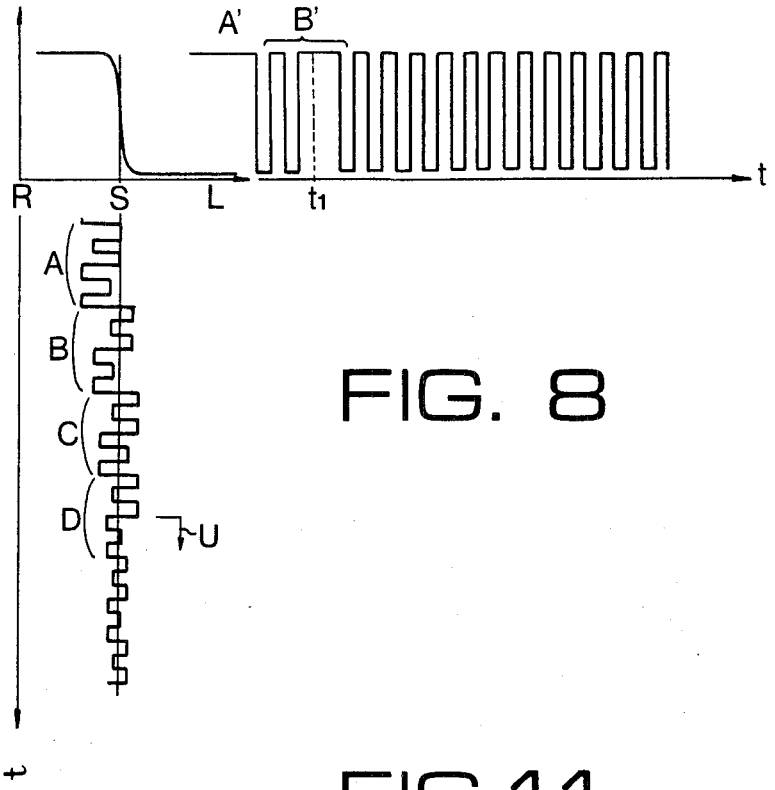
FIG. 8
FIG.11
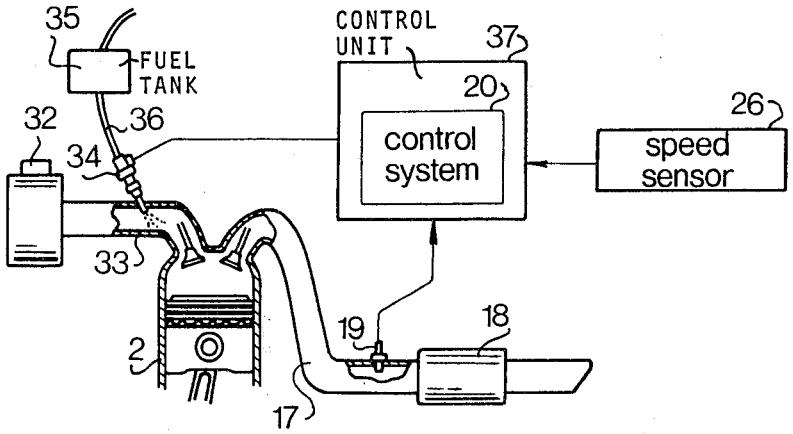

CONTROL SYSTEM

BACKGROUND OF THE INVENTION

The present invention relates to a control system, such as a system for controlling the air-fuel ratio for an internal combustion engine emission control system having a three-way catalyst, and more particularly to a system for controlling the air-fuel ratio to a value approximating the stoichiometric air-fuel ratio of the air-fuel mixture for the engine so as to effectively operate the three-way catalyst.

Such a system is a feedback control system, in which an oxygen sensor is provided to sense the oxygen content of exhaust gases to generate an electrical signal as an indication of the air-fuel ratio of the air-fuel mixture supplied by a carburetor. The control system comprises a comparator for comparing the output signal of the oxygen sensor with a reference value, an integration circuit connected to the comparator, a driving circuit for producing square wave pulses from the output signal of the integration circuit, and an on-off type electromagnetic valve for correcting the air-fuel ratio of the mixture. The control system operates to detect whether the feedback signal from the oxygen sensor is higher or lower than a predetermined reference value corresponding to the stoichiometric air-fuel ratio for producing an error signal for actuating the on-off electromagnetic valve to thereby control the air-fuel ratio of the mixture.

Such a feedback control system inherently oscillates due to the detection delay of the oxygen sensor. More particularly, the mixture corrected by the on-off type electromagnetic valve is induced in the cylinder of the engine passing through the induction passage and burned therein, and thereafter discharged to the exhaust passage. Therefore, at the time when the oxygen sensor detects the oxygen content of the exhaust gases based on the corrected mixture, the corrective action with the on-off electromagnetic valve has overshot the desired point. As a result, a rich or lean mixture caused by the overshooting is induced in the engine and the deviation is detected by the oxygen sensor. Thus, a corrective action in the opposite direction will be initiated. After such oscillation of the control operation, the variation of the air-fuel ratio of the mixture will converge toward the stoichiometric ratio. Therefore, the deviation of the air-fuel ratio of the mixture is corrected to the stoichiometric ratio with some delay. Consequently, the desired reduction of the harmful constituents may not be achieved.

On the other hand, it has been found that if the three-way catalyst is exposed to such exhaust gases that the exhaust gas content ratio oscillates periodically with respect to a mean exhaust gas content ratio at a proper period, the catalyst is activated to thereby increase the emission reduction effect.

SUMMARY OF THE INVENTION

An object of the present invention is to provide a control system in which the controlled output oscillates with a pattern which is so shaped that the direction of the deviation from the desired value may be defined, whereby the deviation from the desired value may be quickly corrected.

According to the present invention, there is provided an air-fuel ratio control system for an internal combustion engine having a pattern which comprises a plurality of positive excursions and negative excursions, at least one of said positive excursions being lower than another of said positive excursions and at least one of said negative excursions being shallower than another of said negative excursions, a shift control circuit means for shifting the level of the center line of said dither signal, driving circuit means for producing a driving output according to said dither signal for driving said electromagnetic means, detecting means for sensing the concentration of a constituent of the exhaust gases passing through said exhaust passage, said detecting means including means for distinguishing a higher value than a reference value corresponding to the stoichiometric air-fuel ratio from a lower value with a steep change, comparing circuit means for comparing the shape of waveform of the output signal of said detecting means with the pattern of said dither signal for detecting a portion removed from the dither signal for producing a signal corresponding to the detected portion, standard reference period generating circuit means for controlling the period of said dither signal and the operation of said comparing circuit, an engine speed sensor for reducing the standard reference period as the engine speed increases, and shift signal generating circuit means operative for producing a shift signal dependent on said signal produced by the comparing circuit means for adjusted said shift control circuit means.

Other objects and feature of the present invention will become apparent from the following description of a preferred embodiment with reference to the accompanying drawings.

BRIEF DESCRIPTION OF THE DRAWINGS

FIGS. 8 to 10 show the relation between the deviation of the dither signal and the output signal of a pattern detecting circuit, FIG. 11 is a schematic view showing another embodiment of the present invention.

DETAILED DESCRIPTION OF THE PREFERRED EMBODIMENT

Figure 1:
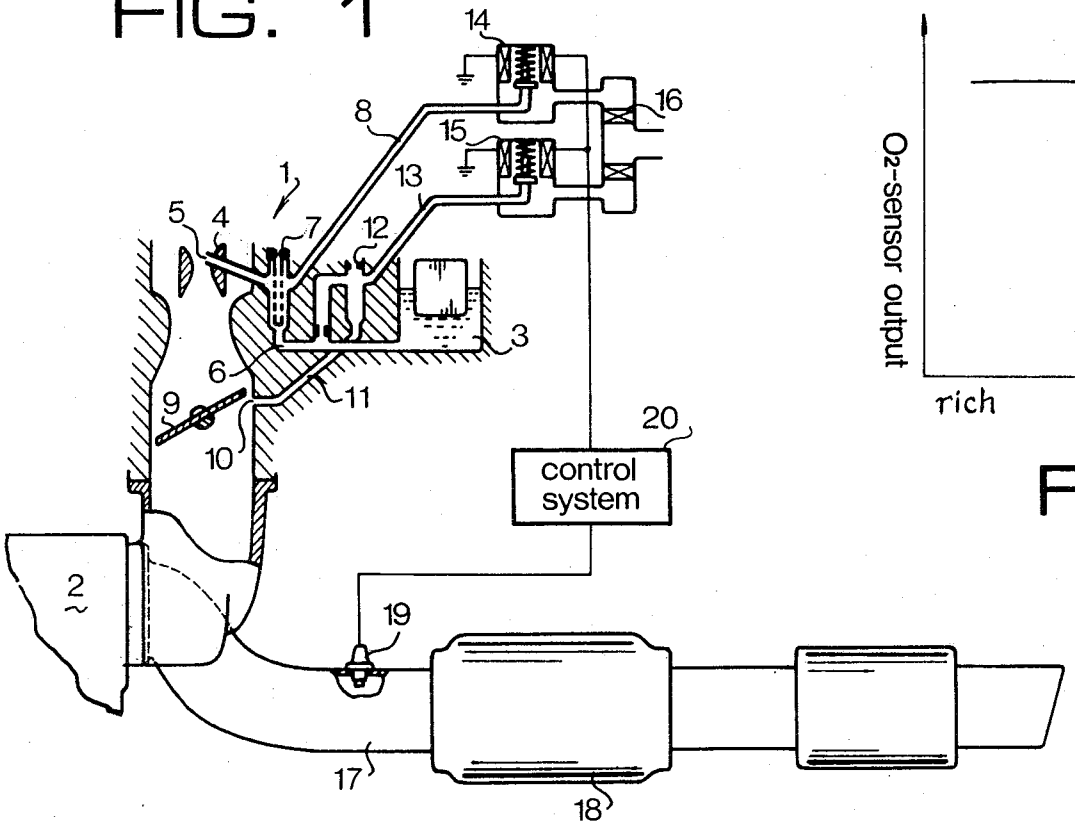
FIG. 1 is a schematic view of an air-fuel control system.

Referring to FIG. 1, a carburetor 1 communicates with an internal combustion engine 2. The carburetor comprises a float chamber 3, a venturi 4 in the intake passage, a nozzle 5 communicating with the float chamber 3 through a main fuel passage 6, and a slow port 10 provided near a throttle valve 9 and communicating with the float chamber 3 through a slow fuel passage 11. Air correcting passages 8 and 13 are provided in parallel to a main air bleed 7 and a slow air bleed 12, respectively. On-off type electromagnetic valves 14 and 15 are provided for the air correcting passages 8 and 13. The inlet port of each on-off type electromagnetic valve communicates with atmosphere through an air cleaner 16. An oxygen sensor 19 is disposed in an exhaust pipe 17 for detecting the oxygen content of the exhaust gases from the engine 2. A three-way catalytic converter 18 is disposed in the exhaust pipe 17 downstream of the oxygen sensor 19.

Figure 2:
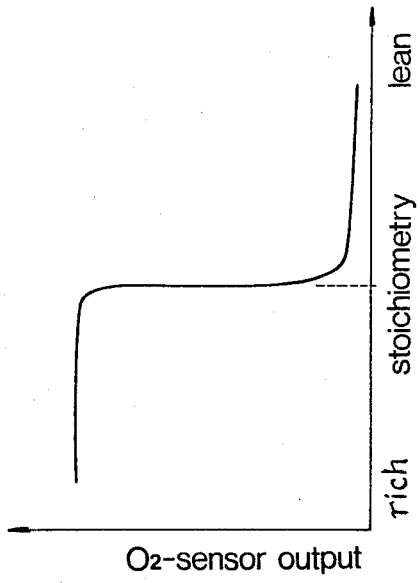
FIG. 2 is a graph showing an electromotive force of the oxygen sensor as a function of the air-fuel ratio of mixture supplied by a carburetor.

The output voltage of the oxygen sensor 19 varies sharply at an exhaust gas ratio near the stoichiometric air-fuel ratio of the mixture supplied by the carburetor as shown in FIG. 2, so that it is possible to detect whether the air-fuel mixture in the intake passage is richer or leaner than the stoichiometric ratio by detecting the voltage of the oxygen sensor 19. The output signal of the sensor 19 is fed to an electronic control system 20 for controlling the on-off type electromagnetic valves 14 and 15.

Figure 3:
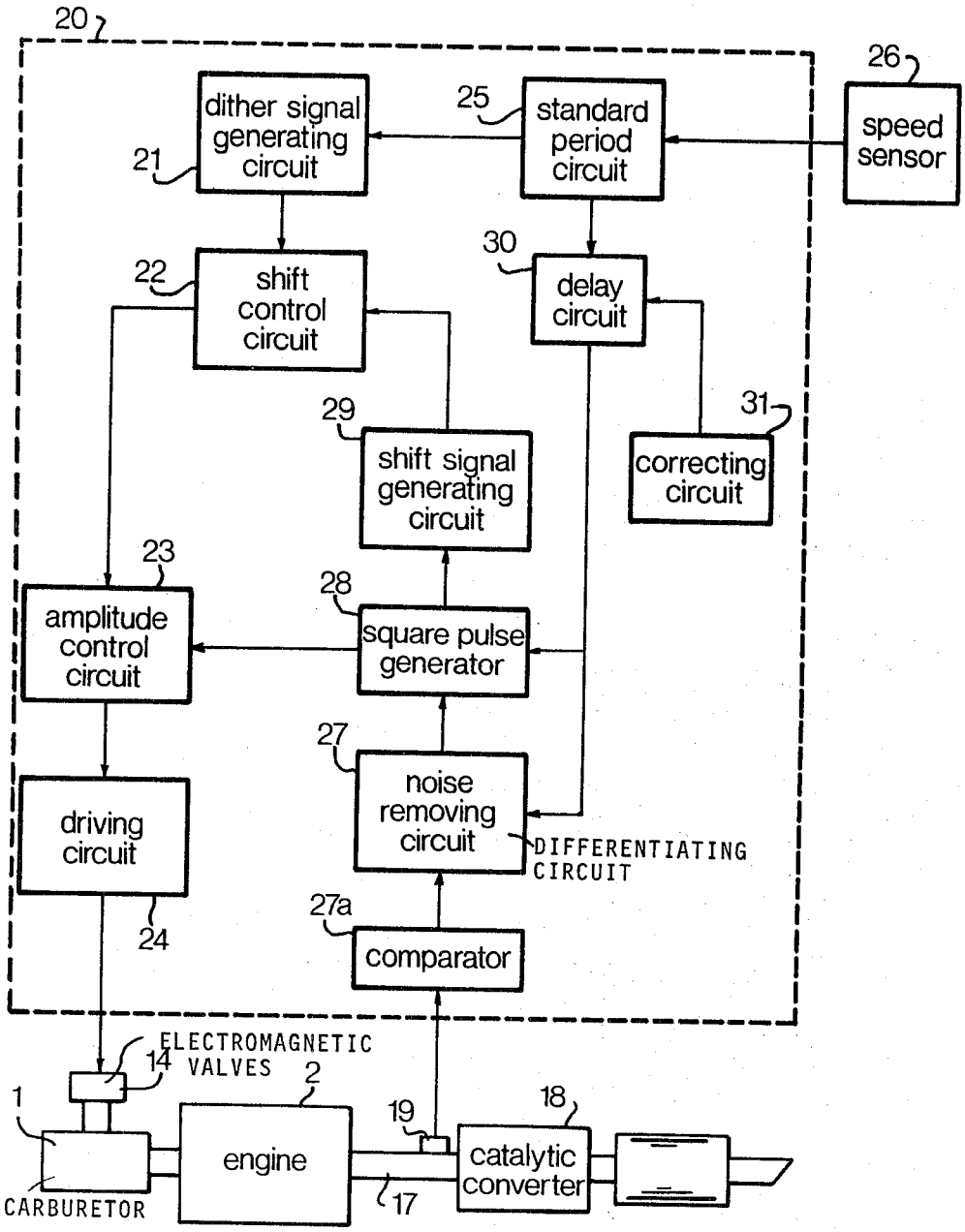
FIG. 3 is a block diagram showing an electronic control system according to the present invention.
Figure 5:
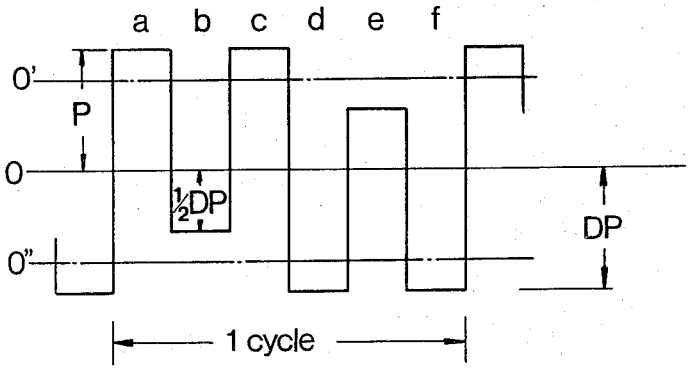
FIG. 5 shows an example of a dither signal.
Figure 7:
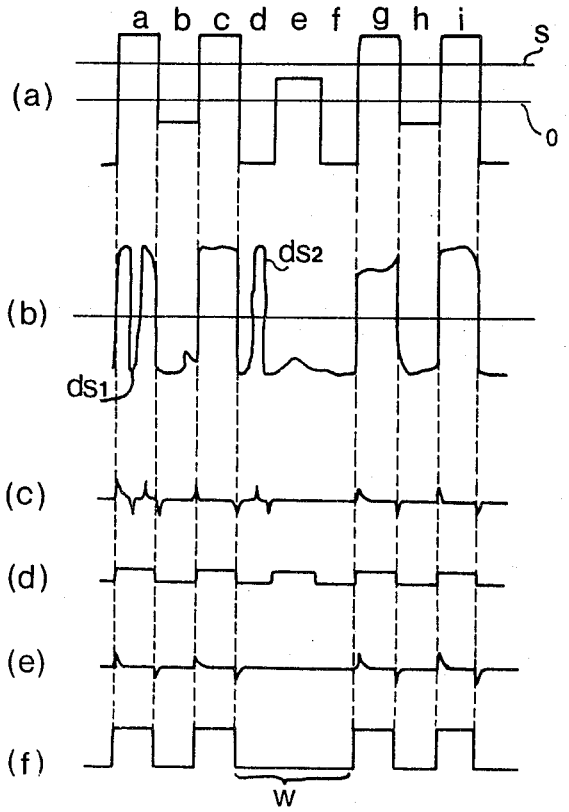
FIG. 7(*a*) shows the dither signal.

Referring to FIG. 3, the electronic control system has a dither signal generating circuit 21 for producing a dither signal (a) of FIG. 7 and FIG. 5. The dither signal (a) is fed to a driving circuit 24 through a shift control circuit 22 (to be explained hereinbelow) and an amplitude control circuit 23. The driving circuit drives the on-off type electromagnetic valves 14 and 15. As shown in FIG. 5 and FIG. 7 the dither signal (a) has a voltage waveform in which a pattern is repeated in cycles. One cycle of the pattern comprises a pair of high positive excursions "a", "c", a low positive excursion "e", a pair of high negative excursions "d", "f" and a low negative excursion "b". The height "P" of the high positive excursion from the center line 0 is equal to the depth "Dp" of the high negative excursion from the center line 0. The height of the low negative excursion "b" from the center line "0", for example, is one-half the height "Dp" of the high negative excursion.

Figure 6A:
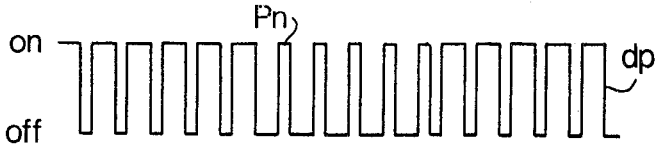
FIGS. 6A and 6B show the relation between the levels of the dither signal and the driving signal.
Figure 6B:
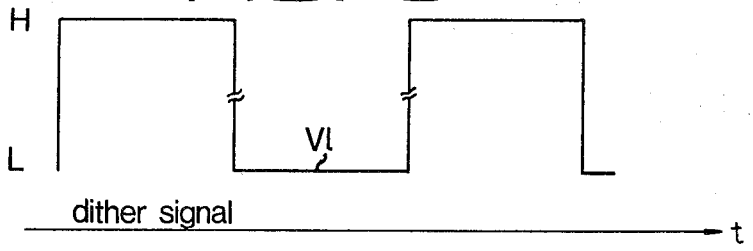

The driving circuit 24 produces driving pulses as shown in FIG. 6A dependent on the input voltage having the dither pattern FIG. 7(*a*). As shown in FIG. 6A, a higher voltage corresponding to the positive excursion of the dither signal causes a driving pulse $d_p$ having a wide width, that is a large pulse duty ratio, and a lower voltage $v_l$ corresponding to the negative excursion of the dither signal causes a narrow duty pulse $p_n$ of a small pulse duty ratio. Therefore, the electromagnetic valves 14 and 15 are actuated by the driving pulses of FIG. 6A in dependency on the voltage of the dither signal. When the valves are actuated by the wide width pulse, a lean mixture is provided since more air enters. The narrow pulse provides a rich mixture. Therefore, the variation of the air-fuel ratio of the mixture supplied by the carburetor has also the same dither pattern.

FIG. 7(*a*) shows the variation of the air-fuel ratio of the mixture having the dither pattern.

When the air-fuel ratio of the mixture having the dither wave of FIG. 7(*a*) deviates from the stoichiometric ratio line "S" toward the lean side as shown in FIG. 7(*a*), the output voltage of the oxygen sensor 17 which detects the exhaust gases corresponding to the mixture varies as shown in FIG. 7(*b*).

Since the small air-fuel ratio of the mixture corresponding to the low positive excursion "e" of the dither pattern in FIG. 7(*a*) is below the stoichiometric ratio line "S", the oxygen sensor does not produce output voltage for the portion "e". Accordingly, the waveform of FIG. 7(*b*) does not induce a wave portion corresponding to the portion "e". However, the output voltage includes noise $dS_1$, $dS_2$ caused by noise generated from the engine. The output voltage (b) of the oxygen sensor is applied to a noise removing circuit 27 via a comparator 27*a*. The noise removing circuit 27 comprises a differentiation circuit and a comparing circuit. The circuit 27 differentiates the output voltage of the oxygen sensor 19 so as to produce the signal as shown in FIG. 7(*c*).

A standard period circuit 25 is provided for producing a standard period pulse train. The phase of the pulses from the circuit 25 is adjusted by a delay circuit 30 so as to coincide with the phase of the output signal of the oxygen sensor (which also corresponds to the phase of the dither signal). This adjusted standard period pulse train is shown in FIG. 7(*d*). The signal of FIG. 7(*c*) is compared with the adjusted standard period pulse train by the noise removing circuit 27, so that noise $dS_1$ and $dS_2$ are removed as shown in FIG. 7(*e*).

The signal of FIG. 7(*e*) is fed to a square pulse generator 28. The square pulse generator 28 produces a square output signal (shown in FIG. 7(*f*)) by triggering with the signal of FIG. 7(*e*).

Since the low positive excursion "e" of the mixture in FIG. 7(*a*) is positioned in the lean side, a wide low level portion "w" is formed in the signal of FIG. 7(*f*). Thus, the fact that the mixture having the waveform of FIG. 7(*a*) is on the lean side can be detected by the lower level portion "w" of the signal (f) derived from the oxygen sensor 19.

Figure 9:
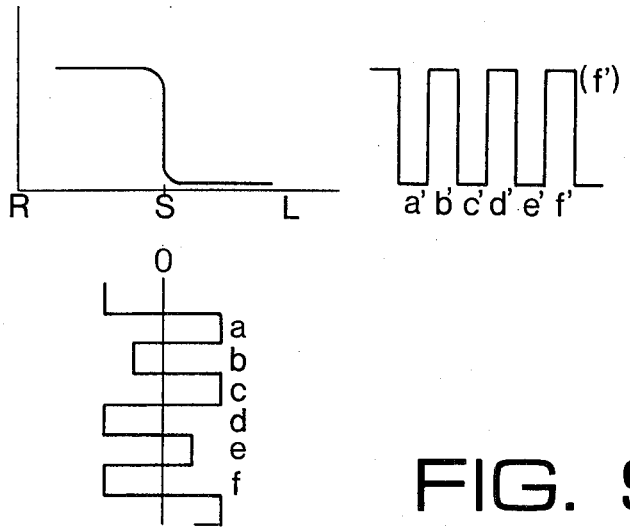

FIG. 9 shows an example of the signal (f') from the square pulse generator 28 when the air-fuel ratio of the mixture is at the stoichiometric value. (Compare the corresponding dither signal (a) but where the center line 0 has been shifted to the stoichiometric line S.) The signal from the pulse generator 28 comprises pulses a' to f' each having the same pulse width.

Figure 10:
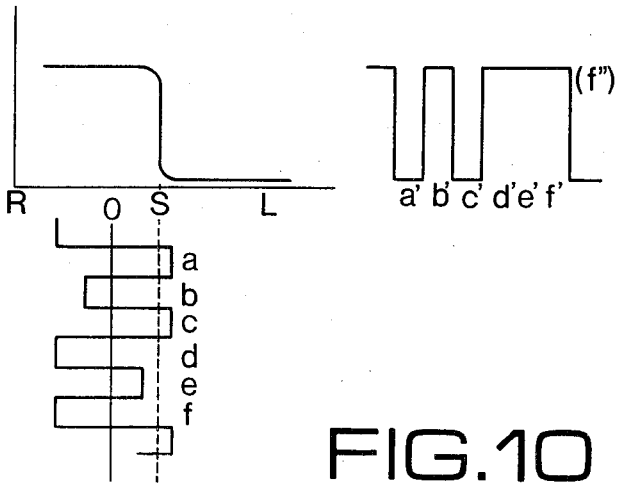

FIG. 10 shows another example of the signal (f'') when the air-fuel mixture deviates to the rich side. (Compare the corresponding dither signal (a) but where the center line 0 has been shifted to the rich side R). The signal (f'') when includes a wide high level portion d', e', f'. That is, if the positive excursion of the dither signal (which corresponds to the air-fuel ratio of the mixture) deviates from the stoichiometric value, a wide high level signal is generated.

The signal (f') or (f'') as the case may be) is fed to a shift signal generating circuit 29 which produces a shift signal dependent upon the width of the high level or low level portion of the signal (f') or (f''). The shift signal (g) is applied to the shift control circuit 22 so as to shift the dither signal (a) fed from the dither signal generating circuit 21 in dependency thereon, that is in dependency on the detected deviation of exhaust gases which in turn is dependent on the air-fuel ratio of the mixture in the intake passage.

FIG. 8 shows an example of the change of the deviation of the dither pattern of the mixture and the variation of the output signal FIG. 7(*f*) of the square pulse generator 28. Assuming that dither pattern "A" completely deviates from the stoichiometric ratio to the rich side, the high level output signal "A'" is produced without negative excursion. Now in dependency on the output signal "A'", the dither signal from the circuit 21 is shifted to the lean side by the shift signal from the shift circuit 29.

If the dither pattern is located as shown at "B" disposed still somewhat toward the rich side, a high level output signal "B'" is produced. Thus, the next dither signal generated from the circuit 21 is shifted by a degree in dependency on the signal "B'". It will be noted that the deviation of the dither pattern of the mixture is detected at the time $t_1$ before the pulse "B'" is completed.

When the center line 0 (in FIG. 5) of the dither pattern of the mixture coincides with the stoichiometric ratio such as the signals "C" or the center line is located in the range between the low positive excursion "e" (FIG. 5) and the low negative excursion "b", uniform pulses are produced. Thus, the generation of a uniform pulse output indicates the fact that the air-fuel ratio (operatively detected by the oxygen sensor) is approximately equal to the stoichiometric ratio. Thus, the shift signal generating circuit 29 does not generate the output signal when receiving the uniform pulse input.

Figure 4:
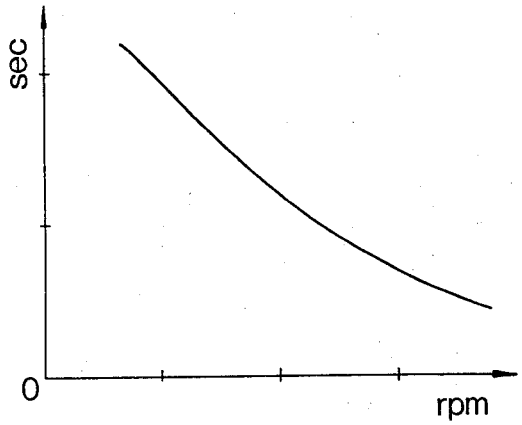
FIG. 4 is a graph showing a relation between the engine speed and the period of the standard signal.

The period of the dither signal from the circuit 21 is provided by the standard period circuit 25, the period of which changes in dependency on the engine speed (rpm) by the signal applied from a conventional speed sensor 26 comprising a transducer. As shown in FIG. 4, this period is increased with decreasing engine speed. When the engine speed is low, the amount of the exhaust gases is small, which means that it is difficult to detect the oxygen content in the exhaust gases with accuracy. The period of the dither signal is increased by the standard period from the circuit as the engine speed decreases. Thus, a reliable control operation in the entire engine speed range may be achieved. A correcting circuit 31 is provided for fine adjustment of the phase adjusting operation in the delay circuit 30.

FIG. 11 shows another embodiment, in which the present invention is applied to an engine, provided with a fuel injection system. A fuel injector 34 is provided on an intake manifold 33 downstream of an air filter 32. The fuel injector 34 communicates with a fuel tank 35 having a fuel pump (not shown) through a conduit 36. The fuel injector 34 is operatively connected to a control unit 37 having the control system 20 of FIG. 3. The oxygen sensor 19 and the speed sensor 26 are provided for controlling the control system 20. In such a system, the fuel injector 34 is operated by the dither signal in the same manner as the previous embodiment, whereby effective emission control may be performed.

Figure 12:
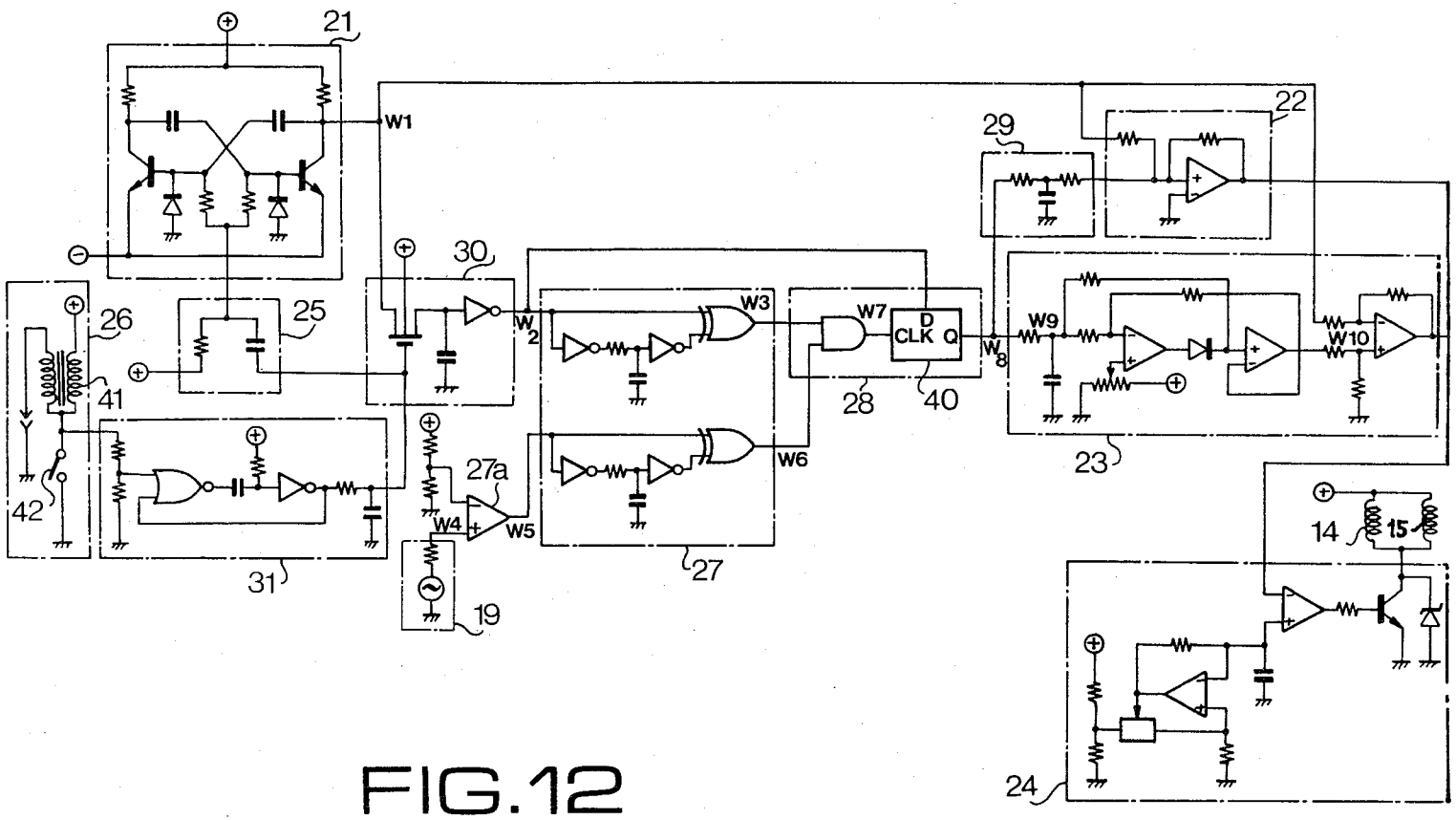
FIG. 12 shows an example of the electronic circuit of the system.
Figure 13:
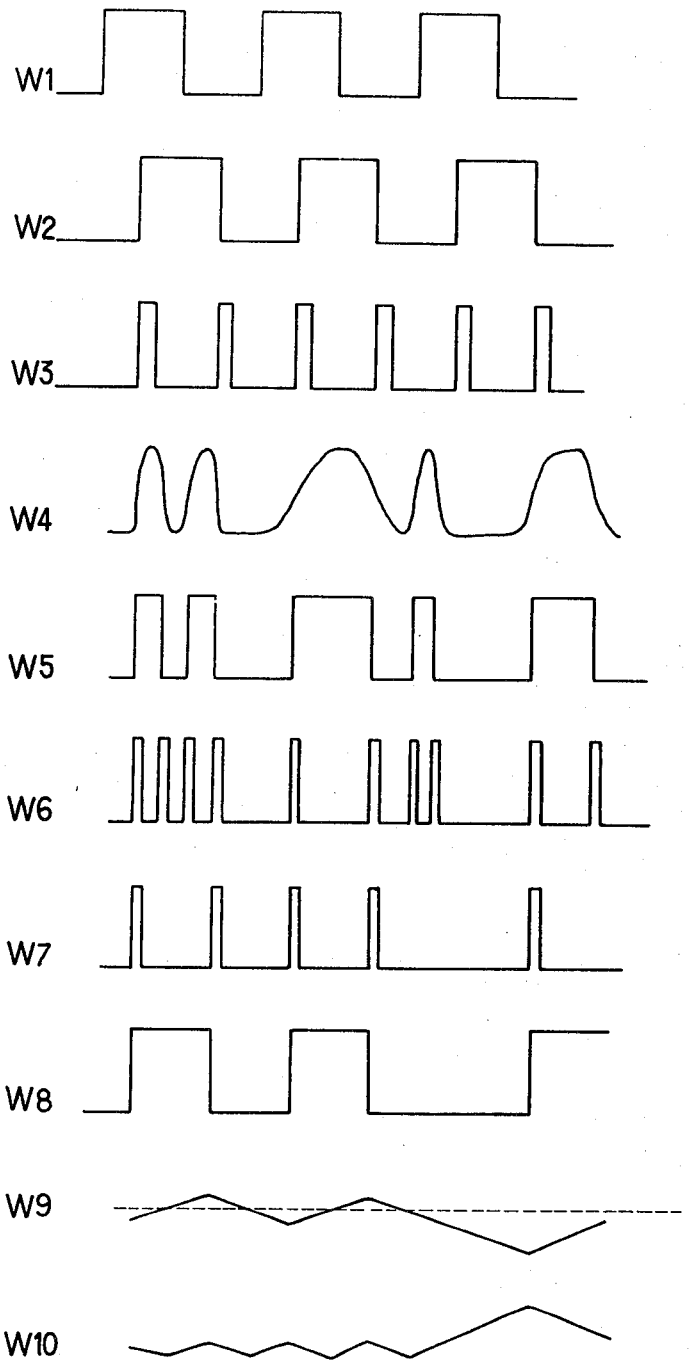
FIG. 13 shows waveforms at various locations in FIG. 12.

FIG. 12 shows an example of the electronic circuit of the system. The square pulse generator 28 comprises a D-JK flip-flop 40. The speed sensor 26 comprises an ignition coil 41 and a distributor contact 42. FIG. 13 shows waveforms at various locations in FIG. 12, in which waveforms $W_1$ to $W_{10}$ correspond to points in FIG. 12 designated by the same reference, respectively.

From the foregoing it will be understood that the present invention provides a control system in which the controlled output that is the process quantity, is caused to oscillate by the dither signal in a pattern, so that the necessary minimum error signal can be produced. Thus, a variation in the output can converge rapidly to the desired value. It will be noted that other dither signals having a different pattern than that of the illustrated signal can be used. When a sensor other than an oxygen sensor is used which has a linear output voltage, it is necessary to provide a comparator by which the output voltage is compared with a standard level corresponding to the stoichiometric ratio so that the output voltage may be sharply changed at the standard level.

What is claimed is:

1. In an air-fuel ratio control system for an internal combustion engine having an intake passage, an exhaust passage, air-fuel mixture supply means, and electromagnetic means for correcting the air-fuel ratio of the air-fuel mixture supplied by said air-fuel mixture supply means, the system comprising dither signal generating means for producing a periodical dither signal having a pattern which comprises a plurality of positive excursions and negative excursions, at least one of said positive excursions being lower than another of said positive excursions and at least one of said negative excursions being lower than another of said negative excursions, a shift control circuit means for shifting the level of a center line of said dither signal, driving circuit means for producing a driving output according to said dither signal for driving said electromagnetic means, detecting means for sensing the concentration of a constituent of the exhaust gases passing through said exhaust passage, said detecting means including means for distinguishing a higher value than a reference value corresponding to the stoichiometric air-fuel ratio from a lower value with a steep change, comparing circuit means for comparing the shape of waveform of the output signal of said detecting means with said pattern of said dither signal for detecting a portion removed from the dither signal for producing a first signal corresponding to the detected portion, reference period generating circuit means having a reference period and for controlling the period of said dither signal and the operation of said comparing circuit means, an engine speed sensor for reducing said reference period as the engine speed increases, and shift signal generating circuit means operative for producing a shift signal dependent on said first signal for adjusting said shift control circuit means.

2. The air-fuel ratio control system for an internal combustion engine according to claim 1 wherein said comparing circuit means includes a noise removing circuit means for removing the noise included in the output signal of said detecting means and a square pulse generator.

3. The air-fuel ratio control system for an internal combustion engine according to claim 2, wherein said reference period generating circuit means is for controlling the operation of said noise removing circuit means and said square pulse generator.

4. The air-fuel ratio control system for an internal combustion engine according to claim 3 further comprising a delay circuit means for adjusting the phase of a reference signal from said reference period operating circuit means so as to coincide with the phase of the output signal of said detecting means.

5. The air-fuel ratio control system for an internal combustion engine according to claim 4 wherein said noise removing circuit means comprises a differentiation circuit means for differentiating the output signal of said detecting means and means for comparing the differentiated signal with the reference signal via said delay circuit means for removing the differentiated signal which does not correspond to the reference signal.

* * * * *